United States Patent [19]

Dahlquist

[11] 3,980,214

[45] Sept. 14, 1976

[54] CONTAINER WITH CONCEALED POURING SPOUT HAVING SEALING FLANGES

[76] Inventor: Kenneth J. Dahlquist, Rte. 1, Box 728, Mount Shasta City, Calif. 96067

[22] Filed: Apr. 18, 1975

[21] Appl. No.: 569,548

[52] U.S. Cl. ..... 222/541; 222/531; 229/7 R; 220/269

[51] Int. Cl.[2] ..... B65D 41/32

[58] Field of Search ..... 220/269, 270; 229/7 R; 222/541, 535, 531

[56] References Cited

UNITED STATES PATENTS

| | | | |
|---|---|---|---|
| 1,897,959 | 2/1933 | Rutkowski | 222/531 |
| 2,327,420 | 8/1943 | Grosse | 222/531 |
| 3,473,705 | 10/1969 | May et al. | 222/541 |

*Primary Examiner*—George T. Hall
*Attorney, Agent, or Firm*—Ernest L. Brown

[57] ABSTRACT

An easy-opening container having a pouring spout within the container, adapted to be pulled outward by a pull member, the pouring spout being characterized by outwardly extending flanges having holes therein, the flanges contacting the inside of the container adjacent the pouring spout to seal between the spout edges and the container when the spout is fully extended.

3 Claims, 5 Drawing Figures

CONTAINER WITH CONCEALED POURING SPOUT HAVING SEALING FLANGES

BACKGROUND OF THE INVENTION

The prior art can best be explained by discussing specific United States patents.

U.S. Pat. No. 3,616,961 teaches a can-like container having a tear strip in the end panel which is unfolded by pulling a pull member. Beads on the end panel provide rigidity where required so that further pulling of the tear strip causes it to bend into a pitcher type pouring lip.

U.S. Pat. No. 3,473,705 teaches a tear strip with a pull tab. The tear strip defines an opening, and as the strip is further pulled, a pour spout is formed by pulling a bendable sheet from the interior of the container through the opening.

U.S. Pat. No. 3,216,609 teaches a container with a tear strip wherein a concealed pre-fabricated spout member is pulled out of the container by pulling the tear strip. The spout has stops on it to prevent full removal from the container.

Unfortunately the latter two spouts are not sealed at their side edges when the spout is open, whereby there is a liklihood of fluid leakage around the spout structure edges.

BRIEF DESCRIPTION OF THE INVENTION

The spout-container combination of this invention also has a tear strip for opening the container and for pulling out the concealed spout. To the end of pulling out and opening the spout, the tear strip is attached to the spout.

The improvement contemplated by this invention is to attach flanges to the inner edges of the spout whereby when the spout is fully opened, the flanges are in mechanical engagement with the inside of the container. The flanges extend outward from the sides of the pouring spout and, incidentally, also act as stops to prevent the spout from being pulled out of the container.

In a preferred embodiment, the flanges have a number of holes formed therein which are sized for the particular fluid within the container such that a small portion of the fluid is positioned within the holes by surface tension, and the surface tension further pulls the flanges into tighter engagement with the container wall. In operation, it is believed that the holes act as small reservoirs, pulling residue of liquid into the holes by surface tension so that it does not leak out of the container around the sides of the pouring spout.

It is therefore an object of this invention to seal a pouring spout.

It is a more specific object of this invention to provide a concealed pouring spout which is sealed around its edges.

BRIEF DESCRIPTION OF DRAWINGS

Other objects will become apparent from the following description, taken in connection with the accompanying drawings, in which.

DETAILED DESCRIPTION OF THE INVENTION

Figure 1:
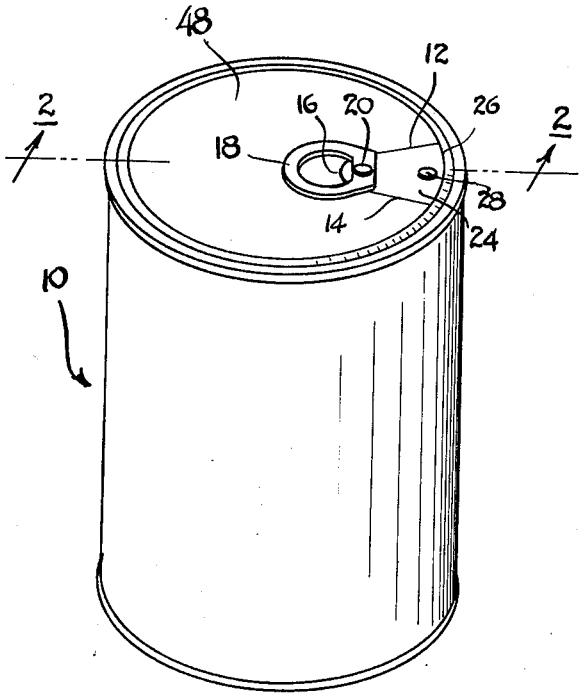
FIG. 1 shows a container having a tear strip, and a concealed spout in accordance with this invention.
Figure 2:
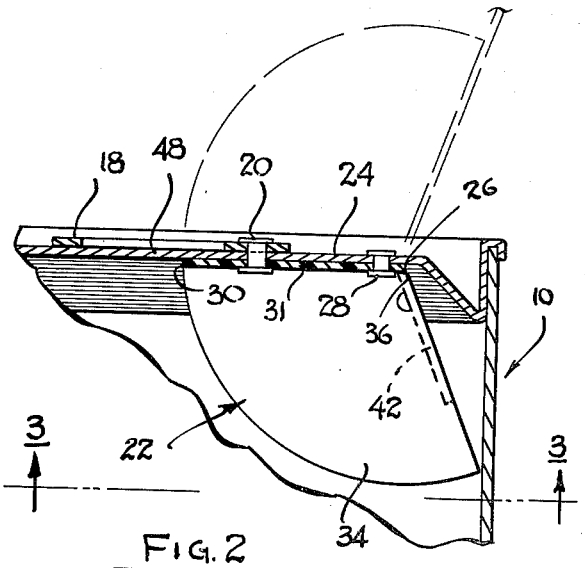
FIG. 2 is a fragmentary view, partly in section, taken at 2—2 in FIG. 1, showing the concealed spout.

A container 10, such as an ordinary can, has an opening defined by score lines 12,14 and 16 which can be pulled open, in accordance with well known art, by a pull tab 18 which is attached to the top of the container by, typically, a rivet 20.

Inside of the container is the pour spout of this invention, shown at 22. The pour spout 22 is connected to the portion 24, defined by score lines 12,14,16 and by the hinge line 26, by rivets 20 and 28.

Figure 3:
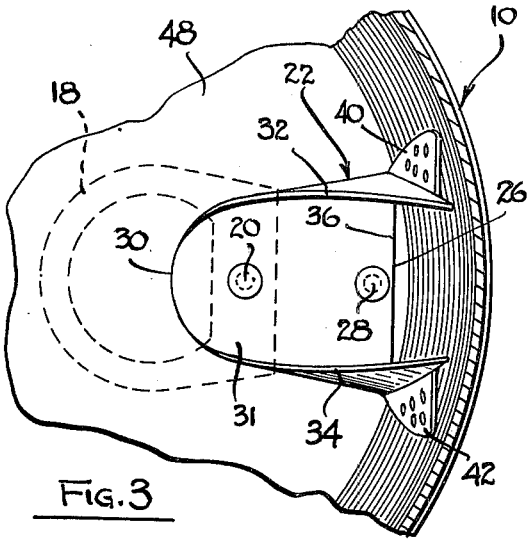
FIG. 3 is a view, partly in section, taken at 3—3 in FIG. 2.
Figure 4:
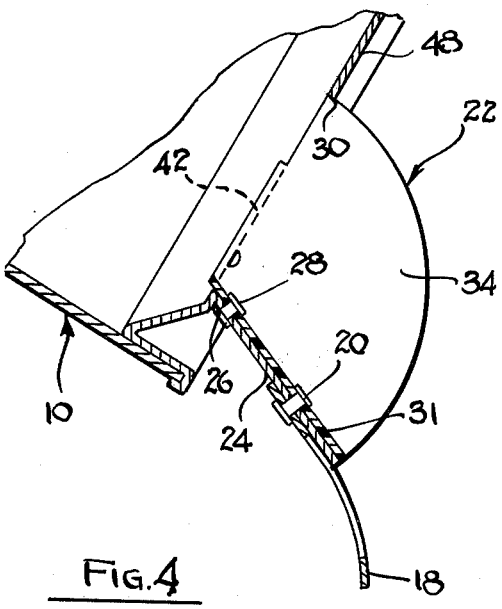
FIG. 4 shows the container of FIG. 1 in pouring position with the spout in opened position.

The profile of the pouring spout 22 may be seen in FIG. 3 wherein the spout 22 is folded into the container 10. The shown spout has a leading pouring lip 30 distal of the hinge line 26 and generally rounded. Two sides 32,34 confine the pouring material. The trailing end 36 of the spout 22 bottom side 31 is proximal the hinge line 26.

Attached to both sides 32,34 are flanges 40,42 which extend outward from the trailing ends 44,46 of the side panels.

Figure 5:
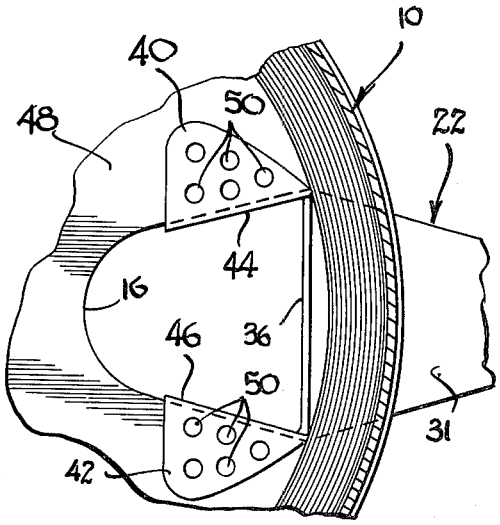
FIG. 5 shows a view of the opened spout, taken from inside of the container and particularly showing the flanges of this invention.

When the spout 22 is within the container 10, the side panels 40,42 are positioned adjacent the side wall of the container 10. When the spout 22 is fully opened, as shown in FIG. 5, the flanges 40,42 are in contact with the lid 48 of the container 10.

A plurality of openings or holes 50 are made in the flanges to facilitate a liquid seal. When the fluid inside of the container (for example, motor oil) gets under the flanges 40,42 the surface tension of the fluid pulls the fluid into the holes 50, and the can does not leak around the edges of the spout 22.

Since the surface tensions of different fluids are different, it follows that the size of the holes or openings 50 are such that fluid will be drawn away from the sides of the spout opening, thereby preventing leakage around the spout.

Although the invention is shown with a particularly shaped spout, it is obvious that the flanges 40,42 could be used with other spouts, and it is intended that the invention shall cover such modifications.

Further, it is intended that the invention shall not be limited by the above description alone, but only in combination with the following claims.

I claim:

1. In combination:

a container having a pull tab type tear strip with a pull member attached thereto to produce an opening in said container upon removal of said tear strip;

a pouring spout attached to said tab, stored inside said container, and contoured to be pulled through said opening from the inside to the outside of said container when said pull member is pulled, including a hinge on one end of said opening for said spout;

the trailing edge of said spout having a pair of sealing flanges extending outward from the side edges of the trailing end of said spout to contact the inner surface of said container and to seal the edges of the open spout against fluid leakage, each of said sealing flanges having a plurality of openings formed therein.

2. A pull-open spout, having a hinge on its attachment end and two substantially parallel upstanding spout sides; and a pair of laterally extending sealing flanges extending outward from the side edges of the trailing end of said spout; each of said sealing flanges having a plurality of openings formed therein.

3. A pouring spout having a bottom panel and two substantially upstanding side panels; and a pair of laterally extending sealing flanges extending outward from the side edges of the non-pouring end of said spout;

each of said sealing flanges having a plurality of openings formed therein.

* * * * *